United States Patent [19]

Ayler et al.

[11] 4,172,408

[45] Oct. 30, 1979

[54] LIQUID PROPELLANT GUN, BREECH PRESSURE AXIAL INJECTION

[75] Inventors: Steve Ayler, China Lake; John Holtrop; Bruce Bartels, both of Ridgecrest, all of Calif.

[73] Assignee: The United States of America as represented by the Secretary of the Navy, Washington, D.C.

[21] Appl. No.: 828,562

[22] Filed: Aug. 29, 1977

[51] Int. Cl.[2] ..... F41F 1/04

[52] U.S. Cl. ..... 89/7

[58] Field of Search ..... 89/7

[56] References Cited

U.S. PATENT DOCUMENTS

| | | | |
|---|---|---|---|
| 2,981,153 | 4/1961 | Wilson et al. | 89/7 |
| 3,782,241 | 1/1974 | Ashley | 89/7 |
| 3,992,976 | 11/1976 | Bartels et al. | 89/7 |
| 4,005,632 | 2/1977 | Holtrop | 89/7 |
| 4,023,463 | 5/1977 | Tassie | 89/7 |
| 4,033,224 | 7/1977 | Holtrop | 89/7 |

*Primary Examiner*—David H. Brown

*Attorney, Agent, or Firm*—R. S. Sciascia; W. Thom Skeer; K. G. Pritchard

[57] ABSTRACT

A liquid propellant gun having a chamber adapted to receive a projectile and liquid propellant and having a breech area containing a fuel injection system and a valve internally thereof and a bolt which is chambered within said valve and adapted to move from a projectile load to a fire position. The movement of the bolt from projectile load to fire position is done in one movement and this is possible in that the valve is able to hold high-pressure, making unnecessary a forward jogging of the bolt before firing.

7 Claims, 4 Drawing Figures

LIQUID PROPELLANT GUN, BREECH PRESSURE AXIAL INJECTION

BACKGROUND OF THE INVENTION

1. Field of the Invention:

The invention relates to liquid propellant guns and more specifically to an injection system for a liquid propellant gun wherein the valve and injector cooperate such that the valve is able to contain high-pressure. This feature of the valve allows the bolt to be moved smoothly from projectile load to fire position without a forward jogging of the bolt after the fuel and oxidizer have been injected and before firing.

In the past it has been necessary, with liquid propellant guns featuring dynamic propellant loading, to protect the propellant injection valve from high breech pressure. This was accomplished by jogging the bolt forward past the valve port following injection such that a seal on the bolt nose held the breech pressure away from the valve. Bolt jog motion however, complicates the overall gun mechanism.

Three separate actuators are required in that the motion of each major component occurs sequentially; injection first, jog second, and bolt lock third. A subsequent operation cannot proceed until the previous operation has been completed.

Such a system would have difficulty achieving the short cycle time necessary for an automatic gun with a high rate of fire.

2. Description of the Prior Art:

Examples of prior art liquid propellant guns are set forth in U.S. Pat. Nos. 3,922,976 and 4,005,632. U.S. Pat. No. 3,992,976 especially focuses on the problem intended to be overcome in the present invention wherein after injection the bolt is moved forwardly thereby translating the projectile, propellant charge and bolt mechanism forwardly until the end of the bolt is ahead of the injector. The bolt mechanism must then be stopped and locked thereby locking the gun before firing. This protects the injector but the bolt actuation and locking system is complicated and must be heavy enough to withstand firing pressures. Also, power requirements are high and the rate of fire is reduced as a consequence of the stop-start action.

SUMMARY OF THE INVENTION

The invention is primarily concerned with a novel valve and injector system wherein the bolt can be moved from projectile load to fire position in one stroke without the necessity for an intermediate stop and a jogging movement when the fuel and oxidizer are injected. This is accomplished by having a valve which is carried internally of an injector piston. The injector piston is moveable axially under the influence of a shoulder on the bolt which picks up the rear portion of the injector piston upon forward movement of the bolt. As the bolt is forced forward it moves the injector piston forward which causes propellant pressure to increase to "pop" the valve open. The valve opens by being moved rearwardly against a holding force. Propellant is then pumped through the valve, into the gun's chamber. The valve is then sealed before firing by having the bolt, on completion of its forward movement, act on a lip on the valve to force it into a closed position.

DESCRIPTION OF THE PREFERRED EMBODIMENT

Figure 1:
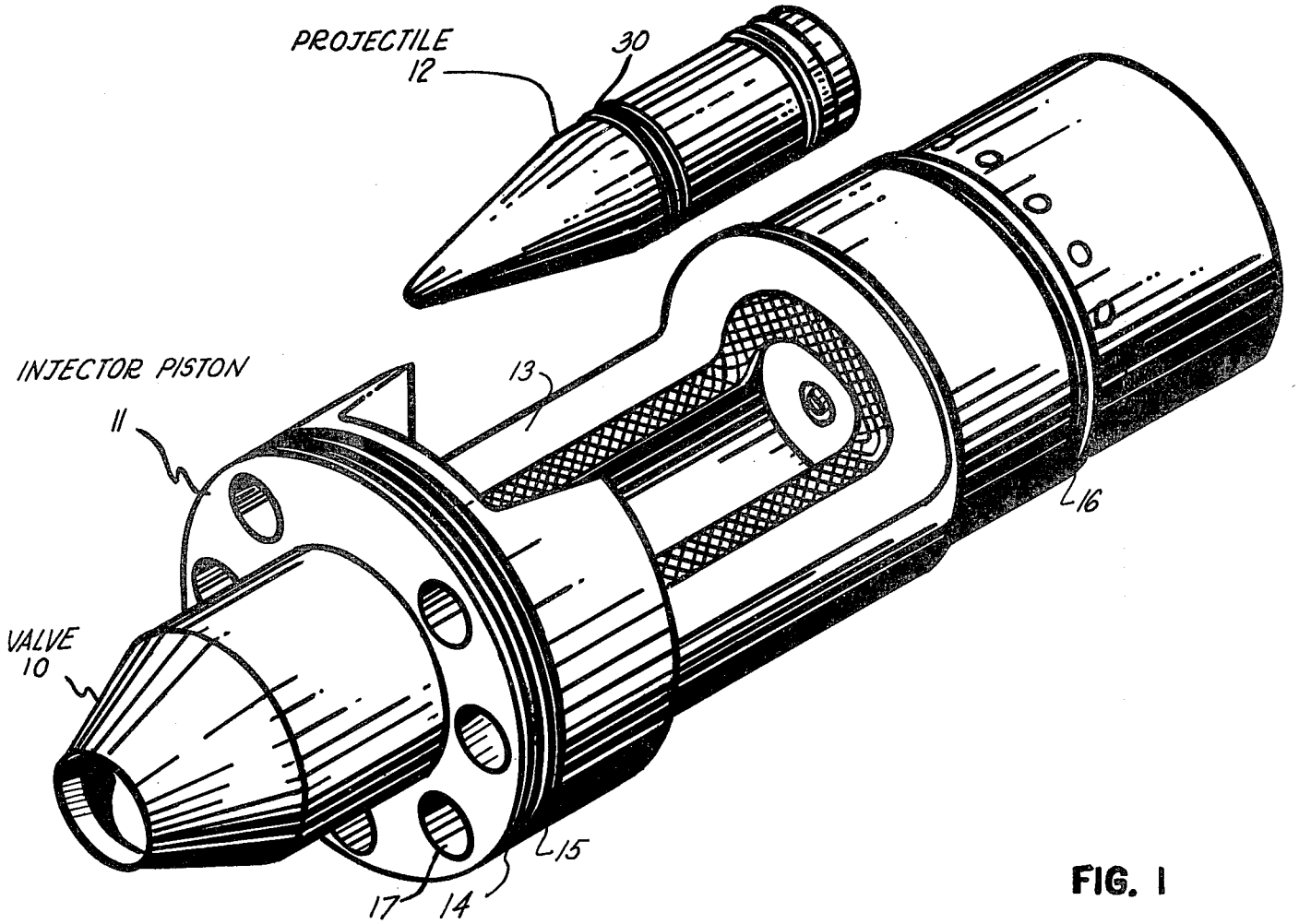
FIG. 1 is an isometric view showing the valve, injector piston and projectile.

FIG. 1 is an isometric view of valve 10, injector piston 11, and projectile 12. As shown in FIG. 1, the injector piston is configured to contain the valve 10 internally thereof. The valve 10 and injector piston are cut away as at 13 to allow the projectile 12 to be chambered internally thereof.

The injector piston has a lip seal 14 and an O-ring seal 15 at the forward portion thereof and O-ring seal 16 at the rearward portion thereof taken with respect to FIG. 1.

Small annular cavities as at 17 are formed at the forward portion of the injector piston 11. The small annular cavities 17 are adapted to receive fuel during operation of the system.

Figure 2:
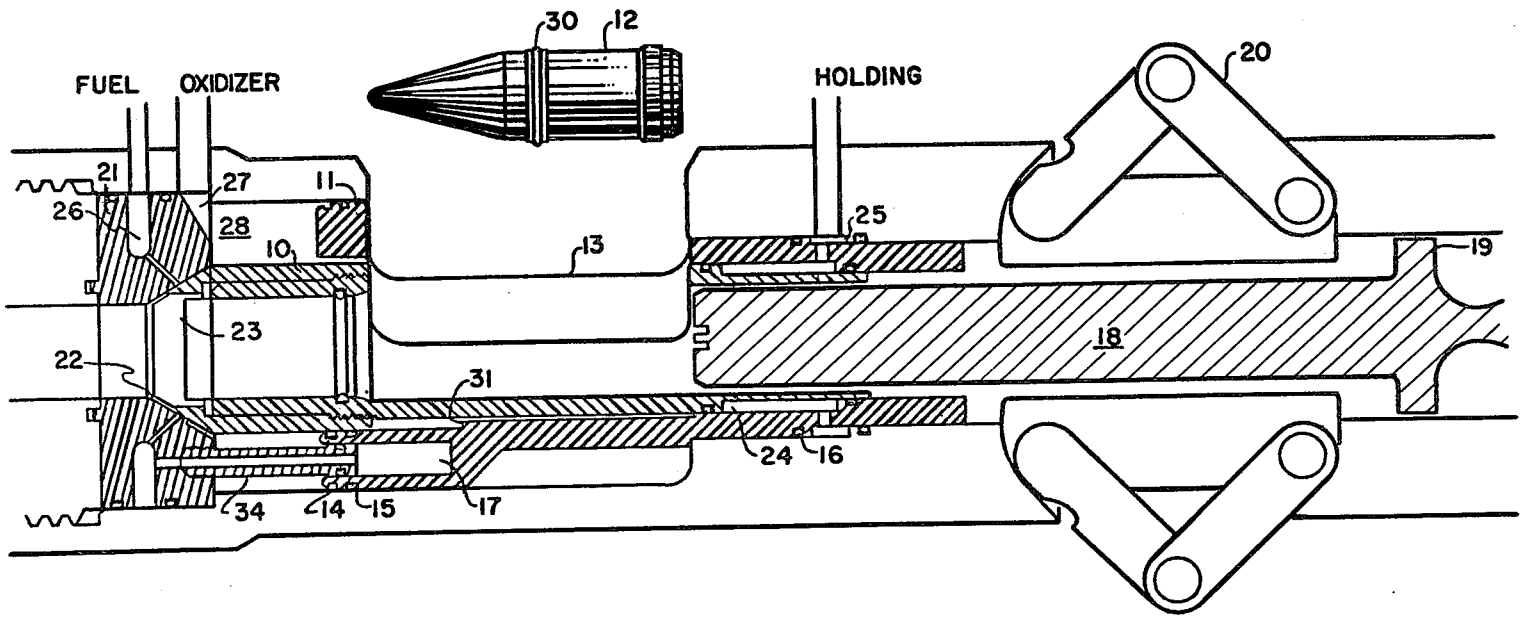
FIG. 2 is a cross-sectional view along the center axis of the rear portion of the liquid propellant gun in a projectile load position.
Figure 3:
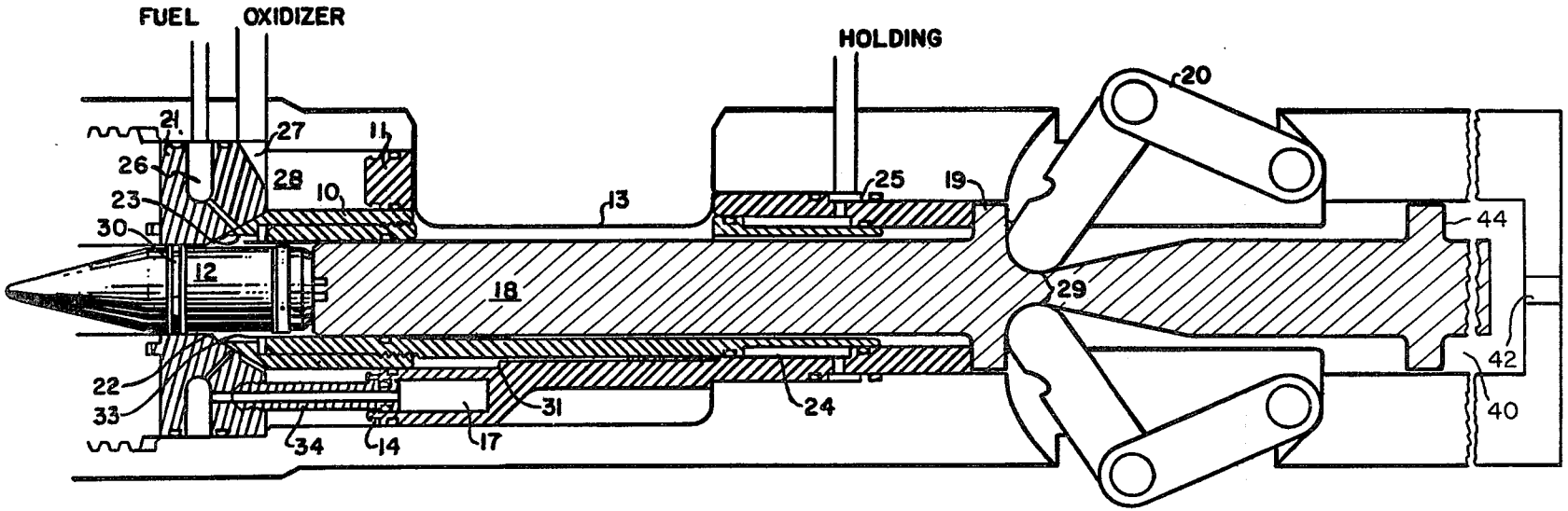
FIG. 3 is a cross-sectional view along the center axis of the liquid propellant gun in the inject position.
Figure 4:
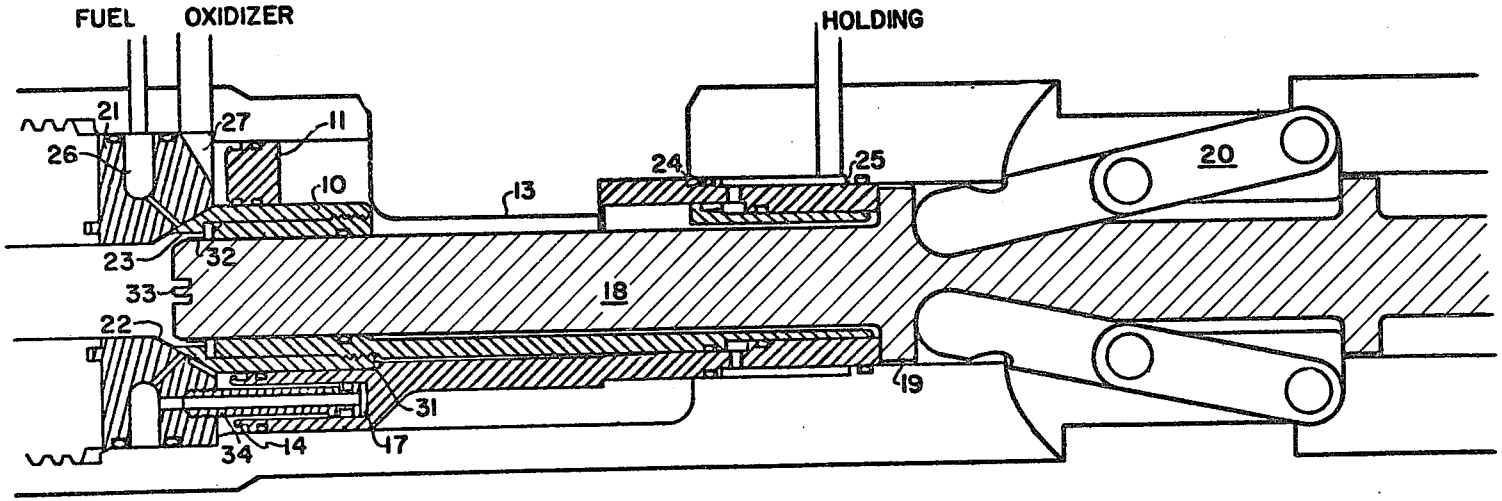
FIG. 4 is a cross-sectional view along the center axis of the liquid propellant gun showing the mechanism in fire position.

Details of the entire assembly are more clearly shown in FIGS. 2, 3, and 4. In FIG. 2, the entire mechanism is in a projectile load position and shows a bolt 18 chambered internally of the valve 10 and having a shoulder 19 at the rearward portion thereof. Also shown is a toggle mechanism 20, the purpose of which will become more clear as the explanation of moving the bolt from unload to load position is gone into. A manifold 21 is fixed internally in the bore of the liquid propellant gun and has a face 22 thereon which cooperates with a seal 23 at the forward end of the valve 10. Carried by the manifold 21 are a series of individual injectors 34 which are received in the small annular spaces 17.

Valve 10 is configured at the rear portion thereof to form a holding pressure chamber 24 which communicates through opening 25 with a holding fluid under pressure.

Fuel and oxidizer are introduced to the manifold 21 via ports 26 and 27 respectively. Oxidizer fills a large annular cavity 28 internally of the gun and externally of the valve 10 while fuel occupies the volume formed by the small annular cavities 17.

The mechanism is shown in the projectile load position in FIG. 2 with again, oxidizer filling the large annular cavity 28 and fuel occupying the series of small axial cavities 17 within the injector piston 11. The holding pressure applied through port 25 to the rear of the valve 10 keeps the valve closed. Projectile 12 is loaded through the area 13 in the valve and injector piston and stops in the valve just forward of the bolt 18.

In FIG. 3, bolt 18 and projectile 12 have been pushed forward until shoulder 19 on the bolt contacts the rear of the injector piston 11. This forward movement is accomplished by hydraulic pressure in chamber 40 which is pumped in through access 42 and pushes against seal 44. The double toggle bolt lock 20 has engaged the bolt 18 at the rear of shoulder 19. A liquid seal 30 on the projectile 12 is seated within the bore of the manifold 21.

At this point, propellant injection begins. Bolt 18 continues traveling forward thereby exerting a force on the rear of the injector piston 11. This raises the propellant pressures in cavities 28 and 17. The increased pressure exerts a force on the forward end of the valve which overcomes the valve holding force in chamber 24 and "pops" valve 10 open by moving it rearwardly with respect to the injector piston 11. Thus it can be seen that valve 10 is a tension closed fitting that only opens when the internal pressure exceeds a predetermined amount.

As the bolt 18 and injector piston 11 travel forward as a unit, propellant is pumped into the sealed cavity behind the projectile 12 thereby pumping the projectile forward with respect to the bolt 18. Near the end of the injection, a step 31 on the inside diameter of the injector piston contacts the valve 10 and forces it closed thereby ending injection.

In FIG. 4, the gun is in fire position. The double toggle 20 holds all of the moving parts of the mechanism in a tightly locked position. A lip seal at 32 uses breech pressure to form a tight seal around the bolt 18 and a second lip seal at 22 seals the injection port in a like manner. With the bolt slightly larger in diameter than the chamber, breech pressure exerts a forward closing force on the valve. This sealing means prevents back pressure damage to the valve, fluid injection means or the chamber behind the bolt. A spark provided at 33 ignites the propellant, causing the projectile 12 to be forcibly ejected from the gun.

The prime advantage of the present system over previous designs is the integration of injection, bolt, and bolt lock functions into simultaneous or smooth rather than sequential operations. In an automatic gun, this will mean shorter cycle time with lower power requirements. By intermittently coupling the bolt and injector piston, the number of actuators is dropped from 3 to 2, bolt and bolt lock.

The major new feature making this possible is the breech pressure valve. With this valve able to hold high-pressure, the need for bolt jog is eliminated. The bolt travel and injection operations can then be coupled together and terminated at the same time. Another new feature of the present invention, is the porting of the valve holding pressure through the injector piston in a manner that exerts no net force on the piston.

The breech pressure valve might be configured alternatively such as the bolt in its locked position bearing on the valve directly but behind the injection port. Breech pressure is allowed to enter the area but its held by a lip seal surrounding the bolt. Since the bolt is configured slightly larger in diameter than the chamber, the high pressure exerts a strong closing force on the valve. Fuel and oxidizer might then be delivered to the valve from a pump located elsewhere in the gun.

What is claimed is:

1. In a liquid propellant gun having a chamber adapted to receive a projectile and liquid propellant the combination comprising:

a gun having a rear portion with a substantially cylindrical hollow breech area having a central axis;

fluid injector means contained within the breech area and having a central axis co-extensive with the axis of the breech area for insecting liquid propellant into said chamber;

valve means contained within the breech area and also having a central axis co-extensive with the axis of the breech area for regulating the injection of said liquid propellant in a predetermined manner;

a bolt contained within said breech area and having a central axis co-extensive with the axis of the breech area and having unloaded and loaded positions;

means for moving said bolt forward from an unloaded to a loaded position; said bolt and fluid injector means cooperating such that when said bolt is moved from the unloaded to the loaded position the fluid injector means is carried along therewith and said valve means is caused to open thereby forcibly injecting liquid propellant into the chamber of said liquid propellant gun duing the initial movement of said bolt forward and where said valve means is closed and sealed upon said bolt reaching its farthest advance such that said gun may be fired without forward jogging of said bolt.

2. In a liquid propellant gun as set forth in claim 1 wherein;

said fluid injector means and said valve means have an opening therein adapted to receive a projectile for loading into the chamber of said propellant gun.

3. In a liquid propellant gun as set forth in claim 2 wherein;

said fluid injector means lies outside and around said valve means.

4. A liquid propellant gun as set forth in claim 1 wherein said fluid injector means comprises:

a hollow piston slideably mounted in a cylinder surrounding said valve means so as to be carried in a compression stroke when said bolt advances a projectile in said chamber, where the chamber of said liquid propellant gun has a tension closed fitting with said piston which is opened to permit liquid propellant into said chamber when said piston compresses fluid within said hollow piston beyond a predetermined pressure; and a step on the inside diameter of said piston for closing said valve means when said piston is at the end of its compression stroke.

5. A liquid propellant gun as set forth in claim 4 further comprising a manifold for injecting either fuel or oxidizer to said chamber through an opening on a face of said manifold where said face forms one surface for the tension closed fitting between said chamber and said piston.

6. A liquid propellant gun as set forth in claim 5 further comprising:

a lip seal on said manifold face within said chamber for supporting high pressure in said chamber that does not backup into said fluid injector means such that further advancement of said bolt in said chamber to prevent such back pressure is not required; and a seal on said bolt for preventing high pressure in said chamber during firing from backing around said bolt.

7. A liquid propellant gun having a chamber adapted to receive a projectile and liquid propellant in the form of fuel and oxidizer comprising:

a substantially cylindrical hollow breech area having a central axis for loading a projectile into said chamber;

fluid injector means contained within said breech area and having a central axis co-extensive with the axis of said breech area for injecting liquid propellant into said chamber;

a bolt contained within said chamber for advancing a projectile forward from its initial placement in said chamber through said breech area;

means for moving said bolt forward in said chamber located in the rear portion of said chamber;

valve means contained within said breech area and also having a central axis co-extensive with the axis of said breech area for regulating the flow of fuel and oxidizer into said chamber in a predetermined manner, said valve means, fluid injector means and bolt cooperating such that when said bolt advances a projectile forward said fluid injector means pumps liquid propellant between said projectile and said bolt through said valve means; and sealing means within said chamber for preventing back pressure through said valve means or around said bolt.

* * * * *